US006064041A

United States Patent [19]

Staffieri

[11] Patent Number: 6,064,041

[45] Date of Patent: May 16, 2000

[54] THERMAL INSULATING DEVICE

[76] Inventor: James Staffieri, 461 Marsh Rd., Pittsford, N.Y. 14534

[21] Appl. No.: 09/112,685

[22] Filed: Jul. 9, 1998

Related U.S. Application Data

[60] Provisional application No. 60/052,208, Jul. 10, 1997.

[51] Int. Cl.[7] ..... A21B 1/00; F24H 7/00

[52] U.S. Cl. ..... 219/399; 126/375

[58] Field of Search ..... 219/399; 126/375, 126/233.5, 273.5, 274; 99/389, 401, 433, 447; 206/542; 220/445; 312/228

[56] References Cited

U.S. PATENT DOCUMENTS

| | | | |
|---|---|---|---|
| 1,069,440 | 8/1913 | Lawrence | 219/399 |
| 1,127,021 | 2/1915 | Klett | 219/407 |
| 3,405,252 | 10/1968 | Laug | 219/399 |
| 4,307,288 | 12/1981 | Stine | 219/521 |
| 4,690,468 | 9/1987 | Lau | 312/291 |
| 4,892,771 | 1/1990 | Rowland . | |
| 4,916,864 | 4/1990 | Thompson | 49/478 |
| 4,917,256 | 4/1990 | Kruck et al. | 220/4 F |
| 5,044,705 | 9/1991 | Nelson | 312/228 |
| 5,460,160 | 10/1995 | Parrott | 126/263.01 |

*Primary Examiner*—Mark Paschall
*Assistant Examiner*—Daniel Robinson
*Attorney, Agent, or Firm*—Jaeckle Fleischmann & Mugel, LLP

[57] ABSTRACT

A detachable thermal insulating device for containing radiant heat produced by an oven includes at least one detachable insulating panel having one surface in contact with the external surface of the oven, the other surface facing away from the oven. The panel has a layer of thermal insulating material that is covered by a flexible heat-resistant covering. The insulating device also includes at least one fastener for holding one of its surfaces in contact with the oven surface. The insulating device substantially reduces the dissipation of heat from the oven to its surroundings.

19 Claims, 3 Drawing Sheets

THERMAL INSULATING DEVICE

CROSS-REFERENCE TO RELATED APPLICATION

This application claims priority from Provisional Application Ser. No. 60/052,208, filed Jul. 10, 1997.

FIELD OF THE INVENTION

The present invention relates generally to a thermal insulating device and, more particularly, to a device for containing radiant heat produced by an oven.

BACKGROUND OF THE INVENTION

Frequently, restaurateurs move the kitchen into the dining area so that diners can witness the food preparation. Of course, an essential feature of such a kitchen is a commercial oven, which in operation radiates enormous amounts of heat. Radiated heat is actually lost energy and increases the operating cost of the oven.

Along with the increasing cost of the oven, the radiated heat can cause substantial discomfort to the preparers of the food as well as to the diners. To improve the comfort of the diners, the restaurateur normally turns on the air conditioning unit. An air conditioner, like an oven, is an expensive appliance to operate. Thus, there is a need to control and maintain the heat generated by a commercial oven to simultaneously decrease the operating costs of the oven and the air conditioning unit. Of course, in cold weather, there may be a benefit to permitting dissipation of some of the radiant heat for the warmth of the diners.

SUMMARY OF THE INVENTION

The present invention is directed to a detachable thermal insulating device for containing radiant heat produced by an oven. The device includes at least one detachable insulating panel having one surface in contact with the external surface of the oven, the other surface facing away from the oven. The panel has a layer of thermal insulating material that is covered by a flexible heat-resistant covering. The insulating device also includes at least one fastener for holding one of its surfaces in contact with the oven surface. The device of the present invention makes possible a substantial reduction in the dissipation of heat from the oven to its surroundings.

DETAILED DESCRIPTION OF THE INVENTION

The present invention is directed to a thermal insulating device that contains radiant heat within an operating oven and substantially encumbers dissipation of heat from the oven to its surroundings. Although the drawings and the description thereof in the specification relate to a commercial oven typically used for the baking of pizzas, it is understood that the device of the present invention is not limited in its usefulness to pizza ovens alone.

Figure 1:
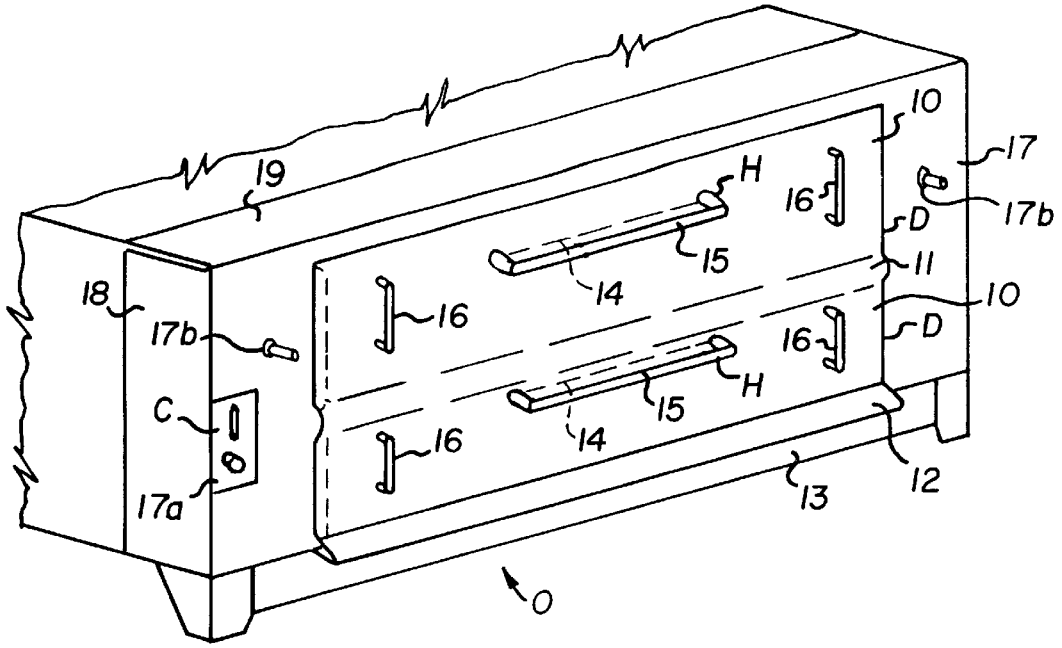
FIG. 1 is a partial isometric view of an oven provided with the thermal insulating device of the present invention.

FIG. 1 depicts an oven O, to whose doors D are affixed insulating panels 10 in accordance with the present invention. The panels 10 are optionally joined by a hinge 11, which, is integral with and constructed of flexible heat-resistant materials that preferably are part of the panels 10 and are effective for reducing the escape of heat from gaps between doors D and the intervening portion of the oven O. A heat deflector 12 that protrudes a short distance from the front surface of the oven O can be connected to the lower of the panels 10. A heat-containing skirt 13 can be connected either to deflector 12 or lower panel 10. Both deflector 12 and skirt 13, which can be combined in a single element, are constructed from a heat-resistant material, for example, a woven fiberglass fabric, as will be described below.

Figure 5:
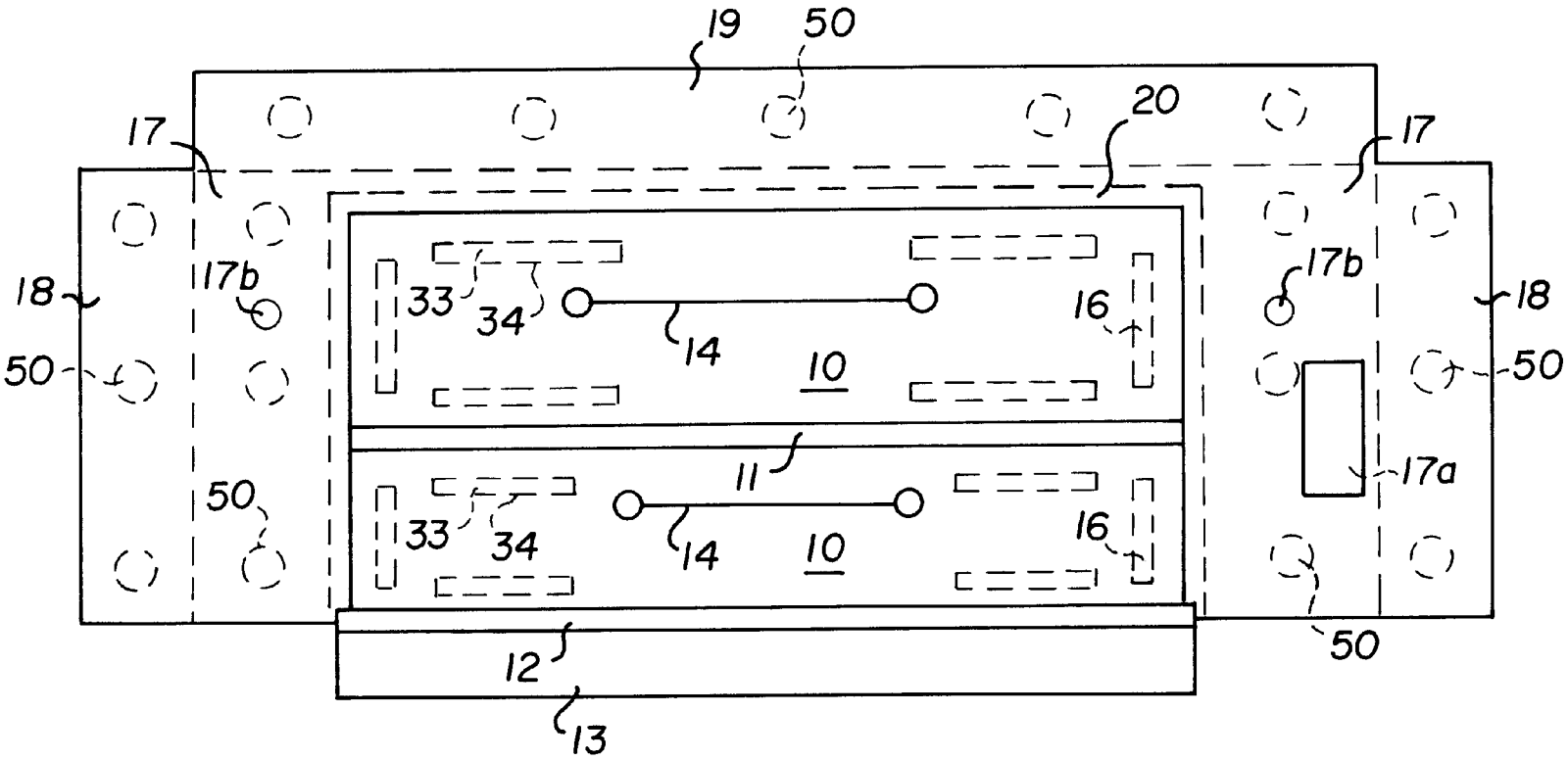
FIG. 5 is an unfolded planar view from the back of the thermal insulating device of the present invention.

Also as shown in FIGS. 1 and 5, panels 10 are each provided with a gap 14, for example, a slit, through which oven door handles H protrude and are thereby made accessible to the baker. Handles H can be provided with insulated covers 15 for the safety and comfort of the baker. Panels 10 are optionally provided with handles 16, formed of a heat-resistant material, to facilitate removal of panels 10 from doors D.

FIG. 1 further depicts an embodiment of the present invention that comprises a face panel 17, which complements panels 10 in reducing heat radiating from the front surface of the oven O. Face panel 17 can be configured with cut-outs 17*a* and 17*b* to allow access to oven controls C. Similarly, thermally insulating side panels 18 and top panel 19, which may cover all or a portion of the sides and top surfaces, respectively, of oven O are provided.

Figure 2:
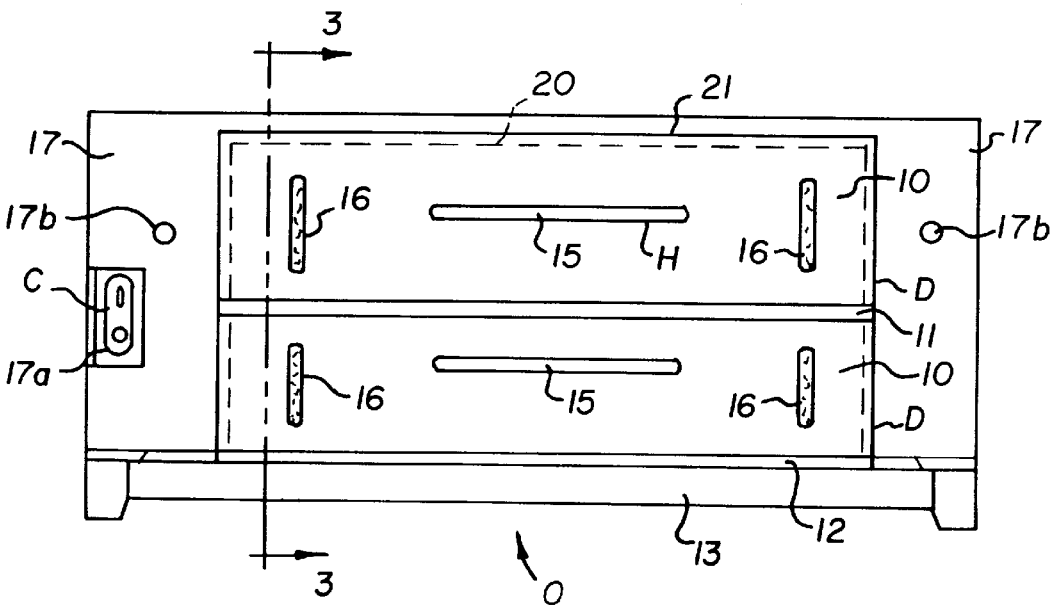
FIG. 2 is a planar view of the front of an oven provided with the thermal insulating device of the present invention.

FIG. 2 is a planar view of the front of the oven O with the thermal insulating device of the invention in place on its surface. In addition to the features of the invention shown in FIG. 1, FIG. 2 depicts an insulating strip 20 attached to the inner side of panel 10 and extending along an edge 21 of door panel 10. Strip 20 serves to prevent the escape of heat through the gap between door D and the frame of the oven compartment, thereby enhancing the effectiveness of the insulating device of the present invention.

Figure 3:
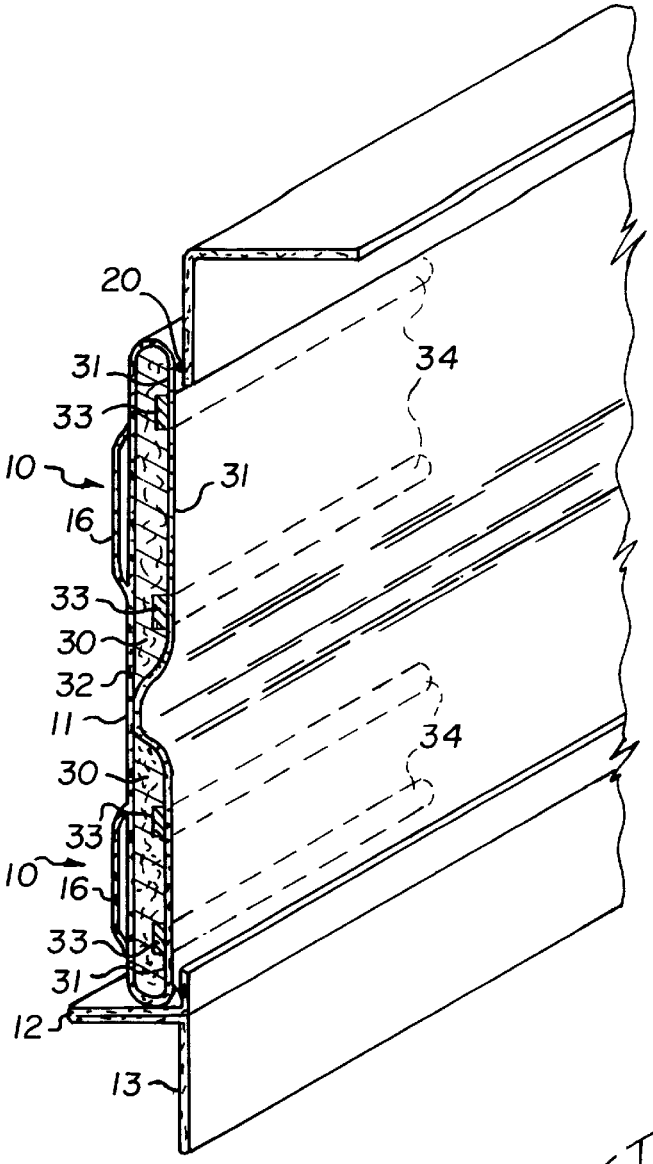
FIG. 3 is an isometric cross-sectional view A of FIG. 2 from the back depicting the device of the present invention applied to the doors of the oven.

FIG. 3 provides further details of an embodiment of the insulating device of the present invention. Door panels 10 comprise a layer 30 of thermal insulating material, for example, a compressed fiberglass mat, which is enclosed by a flexible heat-resistant covering 31. If desired, covering 31 can be adhered to layer 30 using a heat-resistant adhesive, for example, a silicon adhesive available from Dow Corning Corporation or General Electric Company. Hinge 11 can be integral with and formed from the same material as that employed for covering 31. Handles 16, which can be used to remove panels 10 from the oven doors, can also be made of the same material used for covering 31 and can be attached to covering 31 by, for example, stitching. Flexible heat-resistant materials similar to those used for covering 31 can also be employed for the construction of the deflector 12, skirt 13, and insulating strip 20. Suitable flexible heat-resistant materials include, for example, woven fiberglass fabrics, available from Thermotex Industries, Greensville S.C. Suitable materials for insulating layer 30 include mats or boards made of fiberglass, for example, Owens Corning 703 insulating board.

If desired, covering 31 enclosing insulating layer 30 can comprise more than one heat-resistant material. For example, the outer surface 32 as well as handles 16 can be made from a coated material, for example, an aluminized fiberglass fabric, which provides benefits of both improved appearance and ease of cleaning. Coated fabrics of this type are available from, for example, Gentex Corporation, Carbondale Pa.

Also shown in FIG. 3 are magnets 33, which operate as fasteners for holding panels 10 against the external surface of the oven O. Magnets 33, preferably formed of ceramic, can be held in place in panels 10 by sewn pockets 34 formed in covering 31. Magnets 33 as shown can also be embedded in insulating layer 30 to provide a flat surface. Ceramic magnets are available from, for example, Magnet Tech Corporation, Rochester N.Y.

Figure 4:
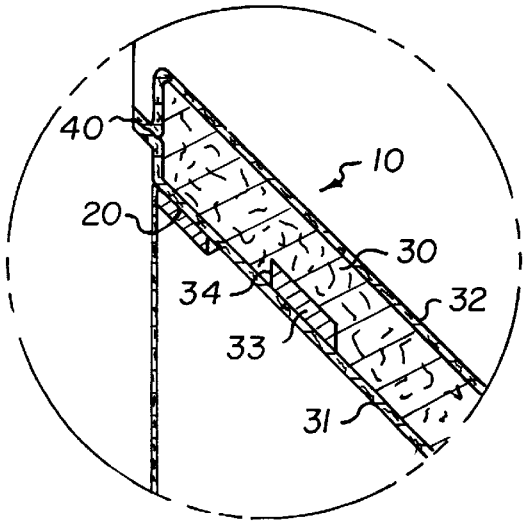
FIG. 4 is an enlarged cross-sectional partial view from the front of a portion of the device of the invention applied to a door of the oven.

FIG. 4 is an enlarged cross-sectional partial view from the front of door panel 10, including insulating layer 30 enclosed by covering 31 on the inward-facing surface and covering 32, which may differ from covering 31 as described above, on the outer surface. Coverings 31 and 32 can be joined together by, for example, stitching 40 or by sealing with a heat-resistant adhesive. Also shown in FIG. 4 are insulating strip 20, magnet 33, and magnet pocket 34.

FIG. 5 is a planar view from the back of an embodiment of the thermal insulating device of the present invention shown in its flat state before being attached to an oven O. In addition to features shown in FIGS. 1–4 and discussed above, FIG. 5 also shows magnets 50, attached by, for example, a heat-resistant adhesive to form face panel 17, side panels 18, and top panel 19 in order to detachably adhere those panels to the oven O. Panels 17, 18, and 19 are conveniently constructed of the same insulated sheet materials such as, for example, aluminum-clad fiberglass fabric on the outer side either alone or with the uncoated fabric on the inner side. Magnets 50, which can be ceramic disk or bar magnets, serve to fasten panels 17, 18, and 19 to exterior surfaces of oven O. If desired, panels 17, 18, and 19 can be constructed as a single element enclosing at least portions of the front, sides, and top of the oven O.

The invention has been described in detail for the purpose of illustration, but it is understood that such detail is solely for that purpose, and variation can be made therein by those skilled in the art without departing from the spirit and scope of the invention, which is defined by the following claims.

What is claimed:

1. For use on a food baking oven that radiates heat to its surroundings in amounts that can cause discomfort to persons and/or overheat ambient environment in proximity to the oven, said oven having an interior, at least a fixed exposed front surface defining an opening for access to the oven interior, and a first and a second exposed oven door, each said door being movable between a closed position and an open position, a detachable thermal insulating device comprising:

a first detachable front insulating panel having an overall surface area sufficient to substantially cover the fixed exposed front surface of the oven and defining a surface engagable directly with said fixed exposed front surface;

second and third detachable front insulating panels each having an overall surface area sufficient to substantially cover the exposed front surface of, respectively, the first and second oven doors and each defining a surface engagable directly with the exposed front surface of, respectively, said first and second oven doors;

each of said detachable front insulating panels comprising a layer of thermal insulating material sufficient to reduce radiant heat emanating from the exposed front surface of the oven, and a flexible, heat-resistant material substantially enclosing said layer of thermal insulating material;

means for detachably holding the first insulating front panel against the exposed front surface of the oven;

means for detachably holding the second and third front insulating panels against, respectively, the first and second oven doors, thereby enabling said second and third panels to move with, respectively, said first and second oven doors as said doors are opened and closed;

wherein the amount of heat radiated from the oven to its surroundings is substantially reduced.

2. A detachable thermal insulating device according to claim 1 wherein the means for enabling the second insulating panel to move with the first oven door comprises a hinge formed from said flexible, heat-resistant material, said hinge connecting said second and third front insulating panels.

3. The thermal insulating device of claim 1 in which the baking oven has at least one exposed external side surface, said device further comprising:

a detachable side insulating panel having an overall surface area sufficient to cover at least a portion of the exposed external side surface and defining a surface engagable directly with said exposed side surface, said detachable side insulating panel comprising a layer of thermal insulating material sufficient to reduce radiant heat emanating from the exposed side surface of the oven, and a flexible, heat-resistant material substantially enclosing the thermal insulating material.

4. The thermal insulating device of claim 1, in which the baking oven has an exposed external top surface, said device further comprising:

a detachable top insulating panel having an overall surface area sufficient to cover at least a portion of the exposed external top surface of the oven and defining a surface engagable directly with said exposed top surface, said detachable top insulating panel comprising a layer of thermal insulating material sufficient to reduce radiant heat emanating from the exposed top surface of the oven, and a flexible, heat-resistant covering substantially enclosing the thermal insulating material.

5. The thermal insulating device of claim 4 further comprising means for flexibly connecting said side and top insulating panels to said first front insulating panel.

6. The thermal insulating device of claim 5 wherein means for flexibly connecting said side and top insulating panels to said first front insulating panel comprise hinges formed from said flexible, heat-resistant material.

7. The thermal insulating device of claim 1 wherein said flexible heat-resistant material comprises a fabric formed of fiberglass.

8. The thermal insulating device of claim 1 further comprising:

an insulating skirt formed of a flexible heat-resistant material, said skirt being flexibly attached to at least one said front insulating panel and extending from said front exposed surface toward the floor supporting the oven.

9. The thermal insulating device of claim 1 wherein the second and third insulating panels are each provided with an opening having dimensions substantially conforming to the dimensions of a handle attached to each said first and second doors, whereby said opening provides access to each said handle.

10. The thermal insulating device of claim 9 further comprising a flexible heat-resistant covering enclosing said handle.

11. The thermal insulating device of claim 1 wherein an insulating panel having dimensions substantially conforming to the dimensions of an oven door further comprises a flexible insulating strip extending along at least one edge of said panel to cover any gaps between the oven front surface and the oven door.

12. The thermal insulating device of claim 7 wherein said layer of insulating material comprises a mat or board formed of fiberglass.

13. The thermal insulating device of claim 1 wherein said flexible heat-resistant covering comprises a metal foil.

14. The thermal insulating device of claim 1 wherein said covering for the front insulating panels each comprises a first portion in contact with an external surface of said oven and a second portion disposed away from oven, said first and second portions optionally being formed from different fabrics.

15. The thermal insulating device of claim 13 wherein said portions of flexible heat-resistant coverings comprise a fabric formed of fiberglass and wherein the second portion further comprises a metallic coating on the outer surface of the fabric.

16. The thermal insulating device of claim 1 wherein said means for detachably holding each comprises at least one magnet.

17. The thermal insulating device of claim 16 wherein said magnet is disposed between said layer of thermal insulating material and said heat-resistant covering.

18. The thermal insulating device of claim 16 said magnet is embedded in said layer of thermal insulating material.

19. The thermal insulating device of claim 16 wherein said magnet is held in a pocket formed on an inner surface of a portion of said heat-resistant covering in contact with an external surface of said oven.

* * * * *